US007344411B2

(12) United States Patent
Ker et al.

(10) Patent No.: US 7,344,411 B2
(45) Date of Patent: Mar. 18, 2008

(54) ELECTRICAL CONNECTOR AND METHOD OF FABRICATING THE SAME

(75) Inventors: Kliff Ker, Chang Hwa (TW); Joe Cheng, Chang Hwa (TW)

(73) Assignee: K.S. Terminals, Inc., Chang Hwa (TW)

( * ) Notice: Subject to any disclaimer, the term of this patent is extended or adjusted under 35 U.S.C. 154(b) by 0 days.

(21) Appl. No.: 11/633,550

(22) Filed: Dec. 5, 2006

(65) Prior Publication Data

US 2007/0212940 A1 Sep. 13, 2007

(30) Foreign Application Priority Data

Nov. 3, 2006 (TW) ..... 95140688 A

(51) Int. Cl.
*H01R 13/648* (2006.01)

(52) U.S. Cl. ..... 439/607

(58) Field of Classification Search ..... 439/607–610, 439/79, 939, 218, 64, 108, 573, 492, 567
See application file for complete search history.

(56) References Cited

U.S. PATENT DOCUMENTS

| | | | | |
|---|---|---|---|---|
| 6,561,849 | B2 * | 5/2003 | Naito et al. | 439/607 |
| 6,840,806 | B2 * | 1/2005 | Kodama | 439/607 |
| 2005/0260871 | A1 | 11/2005 | Kamata et al. | |

FOREIGN PATENT DOCUMENTS

| | | |
|---|---|---|
| JP | 2003-007409 | 6/2001 |
| JP | 2004-151709 | 10/2003 |
| JP | 2005-332749 | 5/2004 |

* cited by examiner

*Primary Examiner*—Edwin A. Leon
(74) *Attorney, Agent, or Firm*—Reed Smith LLP; Stanley P. Fisher, Esq; Juan Carlos A. Marquez, Esq.

(57) ABSTRACT

This invention provides an electrical connector and its fabrication method. The structure of the electrical connector comprises a metallic element, an insulator shell, and a metallic shell. The metallic element comprises a first spring portion extending lengthwise and a second spring portion extending lengthwise in opposition to the first spring portion. The first spring portion and the second spring portion are connected by a near vertical portion. The insulator shell is a hollow rectangular casing which has a fitting portion. The metallic shell is also a hollow rectangular casing and is used to partially clad the insulator shell. The metallic shell has a flexible first slant portion and a flexible second slant portion which extend into the fitting portion of the insulator shell. When the first spring portion of the metallic element extends into the fitting portion of the insulator shell and forms a gap between it and the bent part of the metallic shell, and the second spring portion of the metallic element extends out of the insulator shell, an electrical connector is formed.

2 Claims, 6 Drawing Sheets

ELECTRICAL CONNECTOR AND METHOD OF FABRICATING THE SAME

FIELD OF THE INVENTION

The present invention relates to an electrical connector, and more particularly, to an electrical connector in which a fitting portion is formed by a metallic element and a metallic shell.

DESCRIPTION OF THE PRIOR ART

An electrical connector is a connecting element commonly used in daily life, and therefore there are many kinds of electrical connectors with different forms, structures, and functions. The present invention relates to an electrical connector formed by a metallic element, an insulator shell, a metallic shell, and a locking element. The connection between the electrical connector and terminals with different functions can be achieved by inserting the terminals into the electrical connector.

In the Japanese Patent Application Publication No. 2003-7408 and the US Patent Publication No. US2005/0260871, an electrical connector formed by a plurality of conductive terminals, an insulator shell, a metallic shell, and a conductive ground portion has already been disclosed. Wherein the ground portion and the metallic shell are formed into an integral structure and are disposed in the insulator shell through the plurality of conductive terminals and the conductive ground portion. A portion for fitting the terminals is thus formed for the terminals to be connected.

However, since the conductive ground portion disclosed in the Japanese Patent Application Publication No. 2003-7408 has no elasticity, the terminals may not be efficiently clamped and the connection may fail, which can even lead to damage of terminals. Moreover, due to the lack of elasticity of the conductive ground portion, the terminals cannot be easily removed and may also be damaged more easily, which will cause redundant cost. Although the U.S. Patent Publication No. US2005/0260871 intends to solve the above problems by using elastic material and thus improving the conductive ground portion, yet the patent claims in the examining process that said plurality of conductive terminals and conductive ground portion are arranged in certain direction, in other words, these two elements have to be inserted into the insulator shell in the same direction. This invention makes it easier for the terminals to be inserted into the electrical connector, but the difficulty in fabricating the electrical connector is increased due to a more complex design and formation of the terminals, and the convenience of connecting the electrical connector with different structures to different terminals is also reduced.

SUMMARY OF THE INVENTION

In order to eliminate the defects of the prior art, a main purpose of the present invention is to provide an elastic spring portion to be applied in the metallic shell of the electrical connector, which allows a gap to be formed between the spring portion and the metallic element and leads to better terminal maintenance.

Another purpose of the present invention is to provide an elastic spring portion to be applied in the metallic shell of the electrical connector, which makes it easier for the terminals to reach the correct position when being inserted and results in better clamping effect.

Another purpose of the present invention is to provide an elastic spring portion to be used in the metallic shell of the electrical connector, which prevents the terminals from being damaged when being removed from the electrical connector.

Still another purpose of the present invention is to provide an electrical connector with a simple structure which can be designed and formed more easily and thus reduce the fabrication cost.

And still another purpose of the present invention is to provide an electrical connector with a simpler structure which can be used more conveniently.

Concerning the above purposes, the present invention first provides an electrical connector structure and its fabrication method. The electrical connector structure comprises a metallic element, an insulator shell, and a metallic shell. The metallic element comprises a first spring portion extending lengthwise and a second spring portion extending lengthwise in opposition to the first spring portion. The first spring portion and the second spring portion are connected by a near vertical portion. The insulator shell is a hollow rectangular casing which has a fitting portion. The metallic shell is also a hollow rectangular casing and is used to partially clad said insulator shell. The metallic shell further comprises a flexible first slant portion and a flexible second slant portion which extend into the fitting portion of the insulator shell. When the first spring portion of the metallic element extends into the fitting portion of the insulator shell and forms a gap between it and the bent part of the metallic shell, and the second spring portion of the metallic element extends out of the insulator shell, an electrical connector is formed. Wherein said metallic element and metallic shell are opposite to each other and there is a gap in between. When terminals are inserted into the gap, better terminal maintenance can be achieved. Due to the elasticity of the spring portion, the terminals can reach the correct position more easily and better clamping effect can also be achieved. And because of the elasticity of the spring portion, the terminals can be removed from the electrical connector without being damaged. If the formation of the metallic element is changed, or the relative position or arrangement of the metallic element and the spring portion is changed, or the angle between first spring portion and second spring portion becomes different, the structure of the electrical connector can be adjusted and terminals with different structures can be inserted. Thus the fabrication cost is reduced and the convenience in applying the present invention is increased.

Moreover, the present invention further provides an electrical connector structure and its fabrication method. This electrical connector comprises a metallic element, an insulator shell, a metallic shell, and a locking element. When the metallic shell partially clads the insulator shell, the flexible first slant portion and the flexible second slant portion extend into the fitting portion of the insulator shell, the locking element is disposed in the troughs in the two sides of the insulator shell to be the connecting and locking portion when terminals are inserted. Since the locking element is an individual element that is not connected to the body of metallic shell, the design and formation of the electrical connector can be simpler and the cost in fabricating process can be reduced.

DETAILED DESCRIPTION OF THE PREFERRED EMBODIMENTS

The present invention discloses an electrical connector structure and its fabrication method. Some fabricating or connecting methods applied in the present invention are already disclosed in detail in the prior art. Therefore the methods used to connect different elements will not be described in detail in the following description. And the drawings in the following are not drawn according to actual sizes, the function of which is only to illustrate features related to the present invention.

Figure 1:
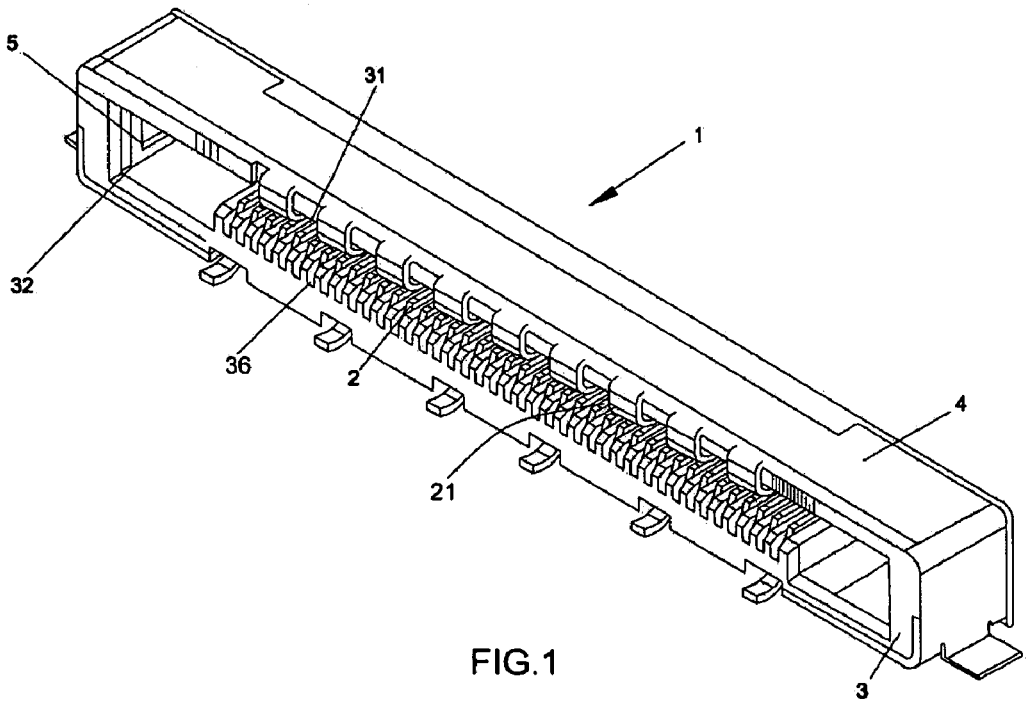
FIG. 1 is a side view of the electrical connector of the present invention.
Figure 2:
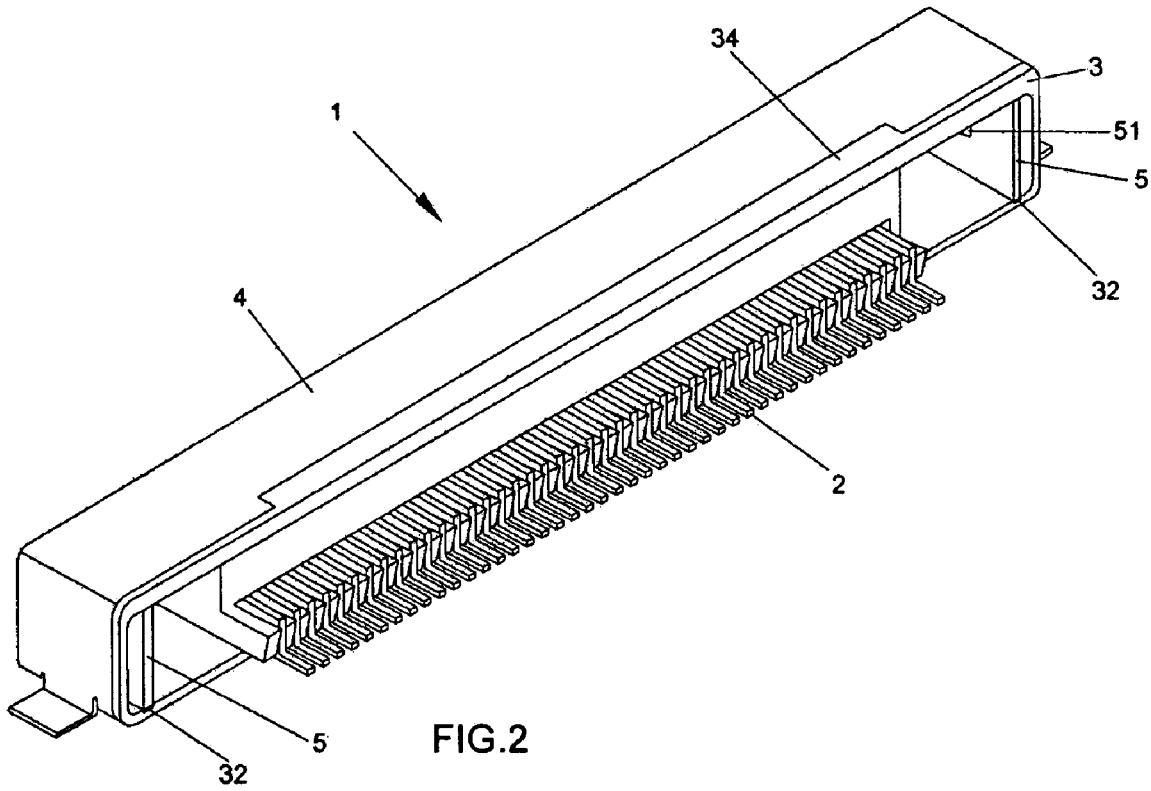
FIG. 2 is a side view of the electrical connector of the present invention.
Figure 3:
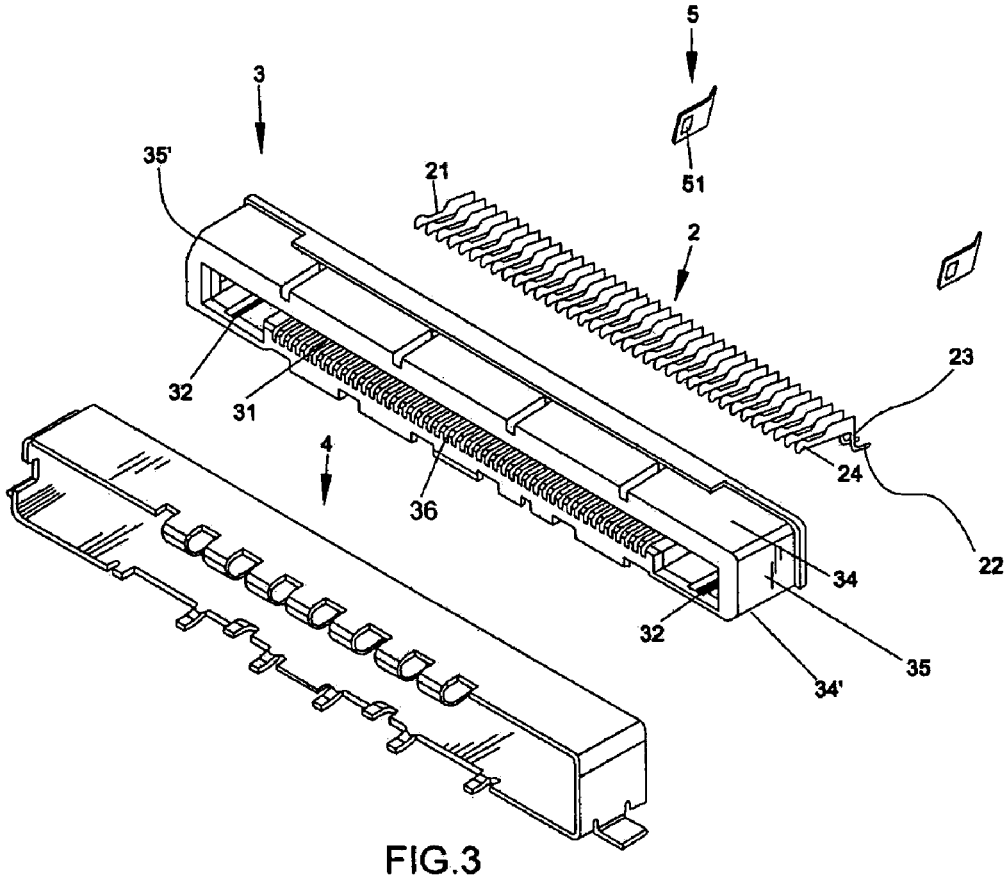
FIG. 3 is an exploded perspective view of the electrical connector of the present invention.

First, referring to FIG. 1, FIG. 2, and FIG. 3, wherein FIG. 1 is a side view of the electrical connector of the present invention, FIG. 2 is another side view of the electrical connector of the present invention from a different direction, and FIG. 3 is an exploded perspective view of the electrical connector of the present invention.

As shown in FIG. 1, FIG. 2, and FIG. 3, the electrical connector 1 of the present invention comprises a metallic element 2, an insulator shell 3, a metallic shell 4, and a locking element 5. Said metallic element 2 and locking element 5 can be made of conductive metal or a kind of alloy material. For example, the conductive metal can be tin, lead, nickel, gold, silver, copper, or bismuth, and the alloy material can be made of metal selected from above. In addition, the insulator shell 3 is made of polymer such as engineering plastic.

The insulator shell 3 is formed by two longer portions with the same width 34 and 34' and two shorter portions with the same width 35 and 35' as an integral element. It is formed to be a hollow rectangular casing and thus its inner hollow portion can be a fitting portion 31. A plurality of contact grooves 36 are disposed in the fitting portion 31 and troughs 32 are disposed in the interior of two sides of the insulator shell 3 respectively. The metallic shell 4 is also a hollow rectangular casing partially cladding the exterior of insulator shell 3. Each first spring portion 21 of metallic element 2 extends into the fitting portion 31 of the insulator shell 3 and connects to the contact groove 36 disposed in the fitting portion 31 of the insulator shell 3.

Figure 4:
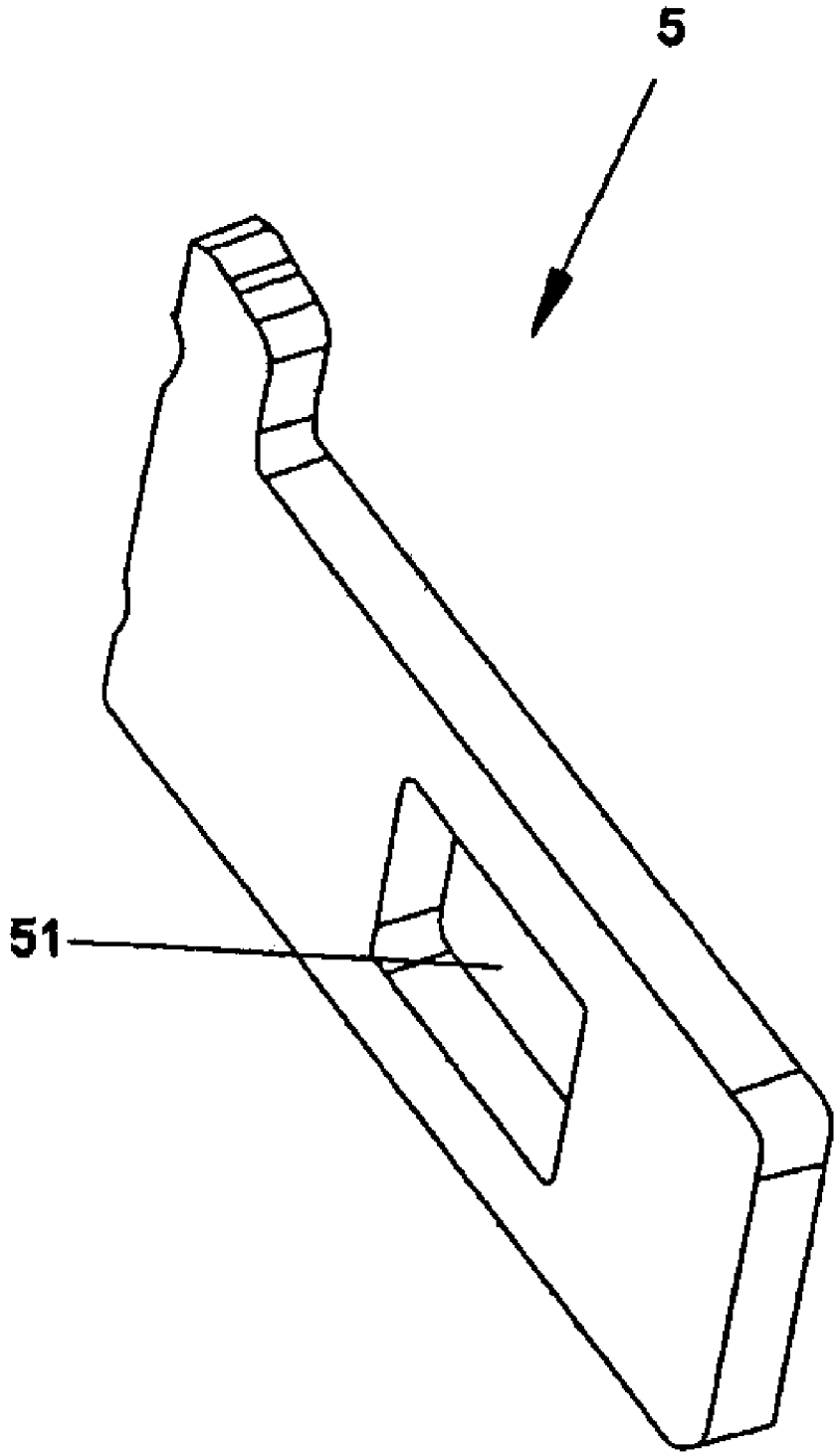
FIG. 4 is a diagram of the locking element of the present invention.

The locking element 5 is inserted into the insulator shell 3 along the troughs 32 and 32' of the insulator shell 3. In a preferred embodiment of the present invention, the height of the locking element 5 can be designed to tightly connect with the inner sides of two longer portions 34 and 34' of the insulator shell 3. And a near geometrical trough portion 51 can be disposed near the center of locking element 5, as shown in FIG. 4. The near geometrical trough portion 51 can be combined with the connection portion of a terminal (the terminal is not shown in the diagram) to achieve the effect of locking the terminal.

Figure 5:
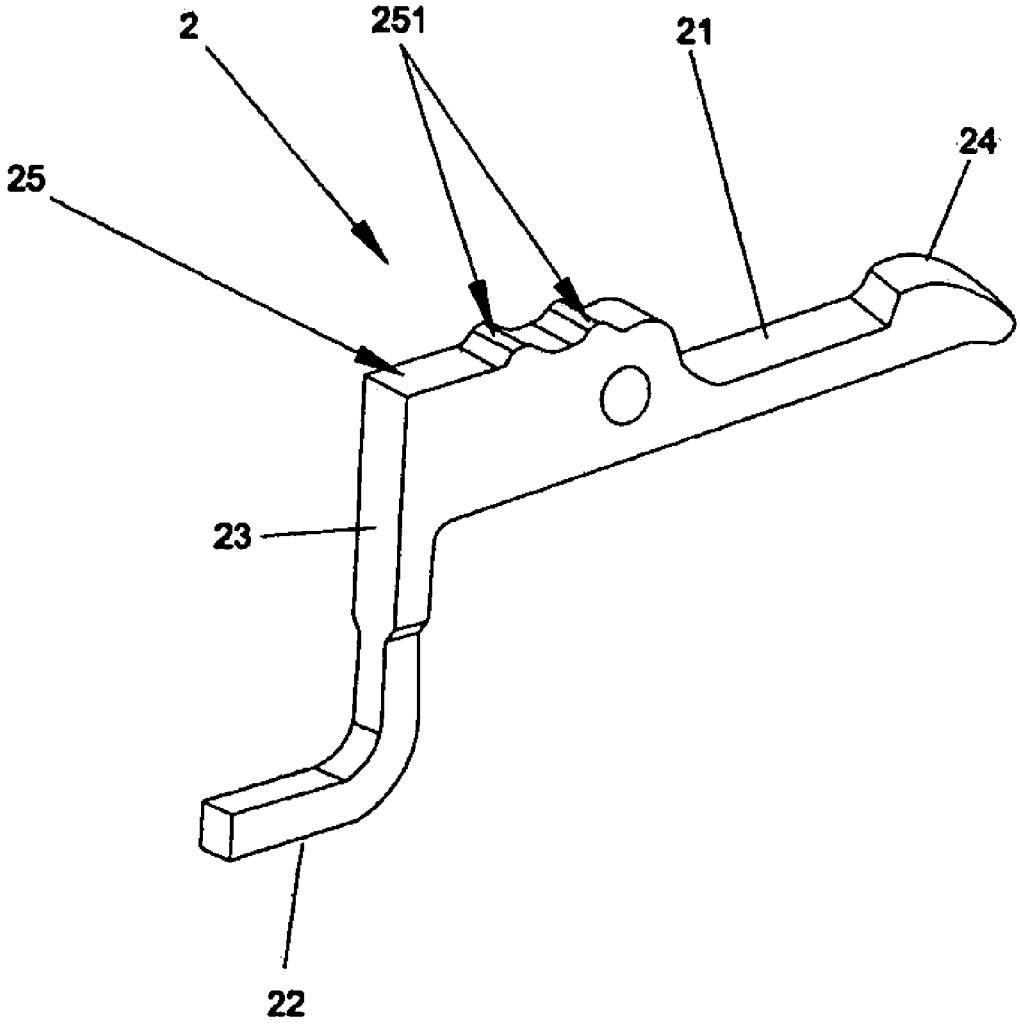
FIG. 5 is a diagram of the metallic element of the present invention.

Then, referring to FIG. 5, which is a diagram of the metallic element. The metallic element 2 comprises a first spring portion 21 that extends lengthwise and a second spring portion 22 that extends lengthwise in opposition to the direction of the first spring portion 21. The first spring portion 21 and the second spring portion 22 are connected by a near vertical portion 23. The end of the first spring portion 21 protrudes and forms contacting portion 24 for contacting terminals and transmitting electric signals. In addition, in the preferred embodiment of the present invention, the shape of the first spring portion 21 described above is similar to a ladder, and at least one protruding point 251 can be disposed on its higher portion 25 to be press-fitted into a part of the hollow rectangular casing of the insulator shell 3.

Figure 6:
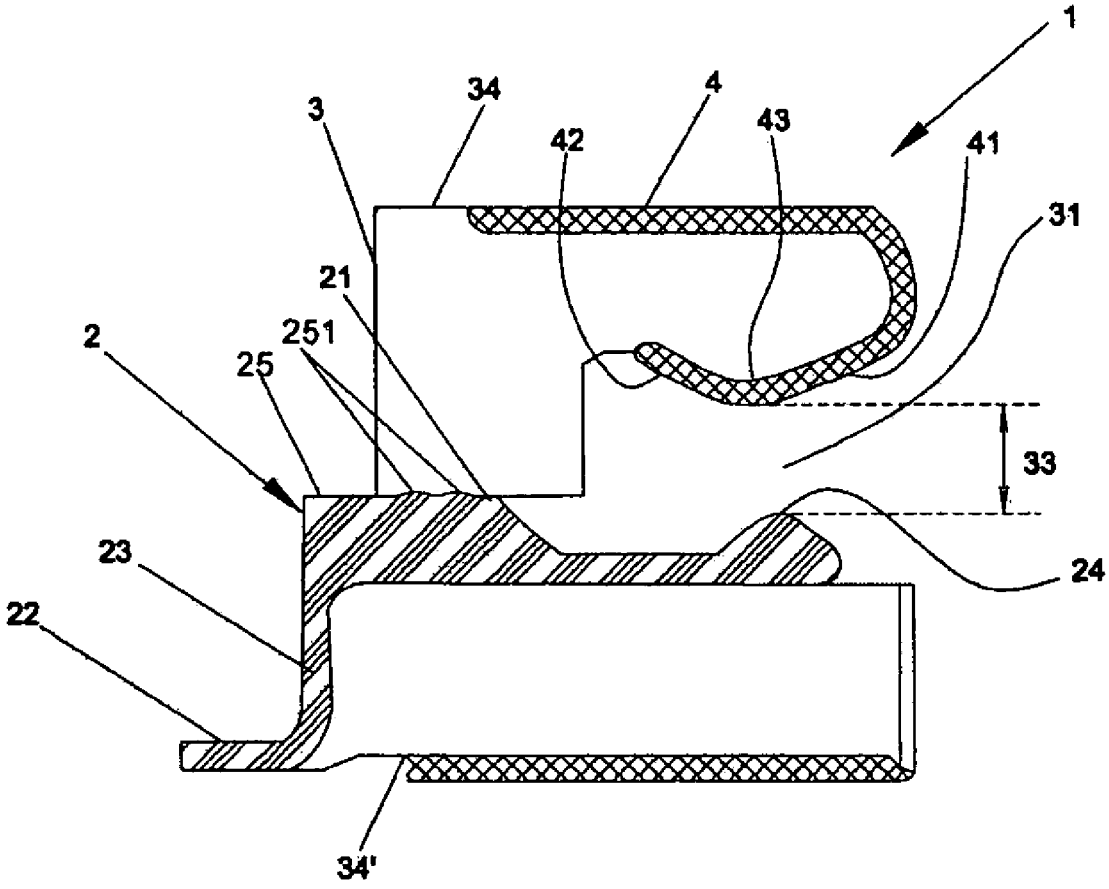
FIG. 6 is a sectional view of the electrical connector of the present invention.

Then referring to FIG. 6, which is a sectional view of the electrical connector of the present invention. As shown in this diagram, the metallic shell 4 partially clads the exterior of the insulator shell 3. The flexible first slant portion 41 and the flexible second slant portion 42 extend from the metallic shell 4 into the fitting portion 31 of the insulator shell 3 and form an angle 43. The flexible first slant portion 41, the flexible second slant portion 42, and the angle 43 all have to become portions contacting terminals and the effect of clamping terminals can thus be achieved. Moreover, a bent portion is formed by the flexible first slant portion 41 of the metallic shell 4. The bent portion can clad the edge of the longer portion 34 of insulator shell 3 and its length can change according to the thickness of the longer portion 34 of insulator shell 3, which increases the convenience of use.

Furthermore, the flexible first slant portion 41 and the flexible second slant portion 42 extend from the metallic shell 4 to the fitting portion 31 of the insulator shell 3. The direction in which they extend can be opposite to that of the first spring portion 21 of the metallic element 2 (as shown in FIG. 6).

And a gap 33 is formed between the slant portions (41, 42, and 43) of the metallic shell 4 and the first spring portion 21 of the metallic element 2. The first spring portion of the metallic element and the slant portions of the metallic shell can be adjusted according to different terminals that are to be connected to and thus the width of said gap 33 will also be different. Obviously, in the present embodiment of the present invention, the gap width of the electrical connector is determined by the contacting portion 24 formed by the protruding end of first spring portion 21 and the slant portions (41, 42, and 43) of the metallic shell. The purpose of which is to achieve better terminal clamping effect.

In the following is the fabrication method of the electrical connector of the present invention, and only the method for the preferred embodiment is described. First, an insulator shell which is a hollow rectangular casing with a fitting portion is provided. Then, a metallic shell which is also a hollow rectangular casing is provided to partially clad said insulator shell. Said metallic shell further comprises a flexible first slant portion and a flexible second slant portion which extend into the fitting portion of said insulator shell. A metallic element comprising a first spring portion extending lengthwise and a second spring portion extending lengthwise in opposition to the first spring portion is then provided, wherein the first spring portion and the second spring portion are connected by a near vertical portion. The electrical connector of the present invention can be formed by extending the first spring portion of the metallic element to the fitting portion of said insulator shell, allowing a gap to be formed between the first spring portion and slant portions of said metallic shell, and extending said second spring portion out of the insulator shell.

What are described above are only preferred embodiments of the present invention and should not be used to limit the claims of the present invention; moreover, the above description can be understood and put into practice by those who are skilled in the present technical field, therefore equivalent changes or modifications made without departing from the spirit disclosed by the present invention should still be included in the appended claims.

What is claimed is:

1. An electrical connector, comprising:

a plurality of metallic elements, each metallic element comprising a first spring portion extending lengthwise and a second spring portion extending lengthwise in opposition to said first spring portion, said first spring portion and said second spring portion being connected by a near vertical portion, the shape of said first spring portion being similar to a ladder, at least one protruding point being disposed on the higher portion of said first spring portion, and there being a protrusive contacting portion at the end of said first spring portion;

an insulator shell which is a hollow rectangular casing with a fitting portion, a plurality of contact grooves being disposed in said fitting portion, a trough being in the interior of each of its two sides, and a part of said hollow rectangular casing connecting to said higher portion of first spring portion of said metallic element and at least one protruding point disposed on said higher portion;

a metallic shell which is a hollow rectangular casing for partially cladding said insulator shell, said metallic shell further comprising a flexible first slant portion and a flexible second slant portion extending into said fitting portion of said insulator shell; and a locking element, disposed in the troughs in two sides of said insulator shell to be connecting and locking terminals, which is not connected to the body of said metallic shell and comprising a near geometrical trough portion near its center;

wherein said first spring portions of said plurality of metallic elements extend to be opposite to said flexible first slant portion and said flexible second slant portion extending into said fitting portion of said insulator shell and connect with said plurality of contact grooves, a gap being formed between said first spring portions and said slant portions of said metallic shell and said second spring portion extending out of said insulator shell.

2. A fabrication method for an electrical connector, comprising the steps of:

providing an insulator shell, said insulator shell being a first hollow rectangular casing with a fitting portion, a plurality of contact grooves being disposed in said fitting portion, a trough being defined in an interior of each of two sides of the insulator shell, and a part of said hollow rectangular casing connecting to a higher portion of a first spring portion of a metallic element and at least one protruding point disposed on said higher portion;

providing a metallic shell, said metallic shell being a second hollow rectangular casing for partially cladding said insulator shell, and said metallic shell comprising a flexible first slant portion and a flexible second slant portion extending into said fitting portion of said insulator shell;

providing a locking element, disposed in the troughs in two sides of said insulator shell to be connecting and locking terminals, which is not connected to the body of said metallic shell and comprising a near geometrical trough portion near its center; and providing a metallic element, said metallic element comprising a first spring portion extending lengthwise and a second spring portion extending lengthwise in opposition to the first spring portion, said first spring portion and said second spring portion being connected by a near vertical portion, wherein said first spring portion of said metallic element extends to be opposite to said flexible first slant portion and said flexible second slant portion extending into the fitting portion of said insulator shell, the shape of said first spring portion being similar to a ladder, at least one protruding point being disposed on the higher portion of said first spring portion, and there being a protrusive contacting portion at the end of said first spring portion and a gap forms between said first spring portion and said slant portions of said metallic shell, said second spring portion extends out of said insulator shell.

* * * * *